US007694853B2

(12) United States Patent
Keller

(10) Patent No.: US 7,694,853 B2
(45) Date of Patent: Apr. 13, 2010

(54) DISPENSING DEVICE COMPRISING A STOPPER AND LOCKING RING WITH BAYONET COUPLING MEANS

(75) Inventor: Wilhelm A. Keller, Merlischachen (CH)

(73) Assignee: MIXPAC Systems AG, Rotkreuz (CH)

( * ) Notice: Subject to any disclaimer, the term of this patent is extended or adjusted under 35 U.S.C. 154(b) by 559 days.

(21) Appl. No.: 10/569,830

(22) PCT Filed: Aug. 20, 2004

(86) PCT No.: PCT/CH2004/000524

§ 371 (c)(1),
(2), (4) Date: Oct. 10, 2006

(87) PCT Pub. No.: WO2005/021394

PCT Pub. Date: Mar. 10, 2005

(65) Prior Publication Data

US 2007/0090079 A1 Apr. 26, 2007

(30) Foreign Application Priority Data

Sep. 1, 2003 (CH) ..... 1498/03

(51) Int. Cl.
*B67D 7/70* (2006.01)

(52) U.S. Cl. ..... 222/137; 222/145.6; 215/332

(58) Field of Classification Search ..... 222/137, 222/325–327, 52, 165, 105, 498, 499, 145.6, 222/145.5, 567, 136; 215/332, 296, 356, 215/320, 222, 357

See application file for complete search history.

(56) References Cited

U.S. PATENT DOCUMENTS

| | | | | |
|---|---|---|---|---|
| 5,137,182 | A | | 8/1992 | Keller |
| 5,320,233 | A | | 6/1994 | Welch |
| 5,423,443 | A | | 6/1995 | Keller |
| 5,456,830 | A | * | 10/1995 | Stanford et al. ..... 210/235 |
| 5,918,772 | A | * | 7/1999 | Keller et al. ..... 222/145.6 |
| 5,944,226 | A | * | 8/1999 | Schiltz et al. ..... 222/137 |

* cited by examiner

*Primary Examiner*—Lien T Ngo
(74) *Attorney, Agent, or Firm*—Foley & Lardner LLP

(57) ABSTRACT

In the dispensing device, preferably a double cartridge (1) having a stopper and a locking ring provided with bayonet connecting means, the stopper (7), the external surfaces of the cartridge outlets (4, 5), and the wall interior of the locking ring (6,) comprise mutually cooperating means (17, 26; 18, 27) for pressing the stopper into the outlets or pulling it out from the outlets as the locking ring is rotated. On one hand, this allows to obtain a tight closure, and on the other hand, it is very simple in this manner to pull out the tightly fitting stopper.

19 Claims, 4 Drawing Sheets

DISPENSING DEVICE COMPRISING A STOPPER AND LOCKING RING WITH BAYONET COUPLING MEANS

The present invention refers to a dispensing device comprising a stopper and locking ring with bayonet coupling means according to the preamble of claim 1. Dispensing devices of this kind, more particularly multicomponent cartridges, are e.g. known from U.S. Pat. No. 5,918,772 to the applicant of the present invention. The advantage of bayonet coupling means over screwed connections is that they allow quick connecting and disconnecting. On the other hand, bayonet coupling means also have disadvantages, particularly in the case of larger cartridges where greater forces may be required. The issue not only regards the connection of a mixer or an accessory but also to the withdrawal of the stopper, whose plugs are slightly conical on account of the required tightness and which is therefore firmly in place.

From U.S. Pat. No. 5,137,182 to the applicant of the present invention, a stopper for a cartridge is known where the upper side of the bayonet cams may be wedge-shaped to achieve a better locking action.

U.S. Pat. No. 5,320,233 discloses a closure having means for indicating that a safety band has been torn. The two-part safety band comprises lugs on either side of a weakened zone, one series of lugs sliding on one cam and the other series on another cam, thereby tearing the band apart when the closure is opened.

For cartridges having a threaded coupling ring for the attachment of a mixer or a stopper, e.g. according to U.S. Pat. No. 5,423,443, it is known to provide the stopper with a traction disk for removing it by unscrewing the coupling ring. While the threaded coupling ring provides a relatively large travel for lifting off the stopper, a conventional bayonet lock cannot exert a traction force. Hence, for larger cartridges having larger stoppers, this problem has remained unsolved up to now.

On this background, it is the object of the present invention to solve this problem and to provide a possibility in a bayonet lock for displacing the stopper by means of the locking ring in such a manner that it is not only moved toward the dispensing device for its closure but also capable of being lifted off therefrom and therefore exerts a traction force. This object is attained by the characteristic features of claim 1.

The invention will be explained in more detail with reference to drawings of an exemplary embodiment.

Figure 1:
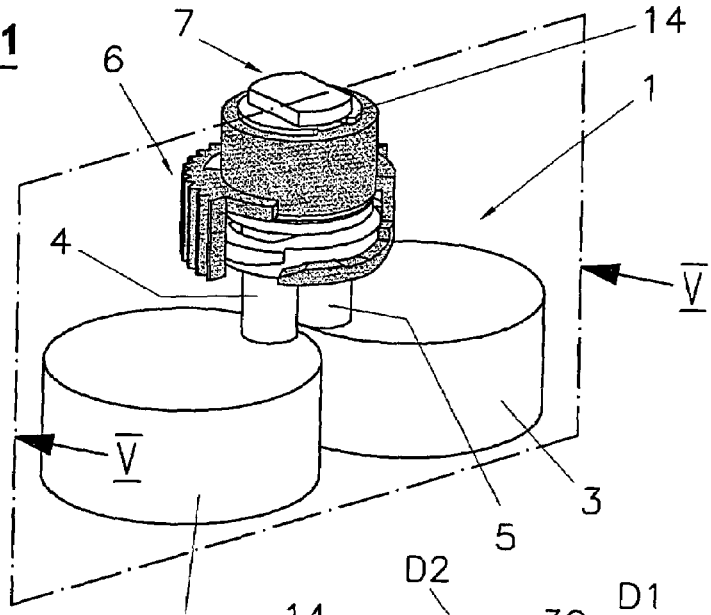
FIG. 1 shows an exemplary embodiment of a device according to the invention.
Figure 2:
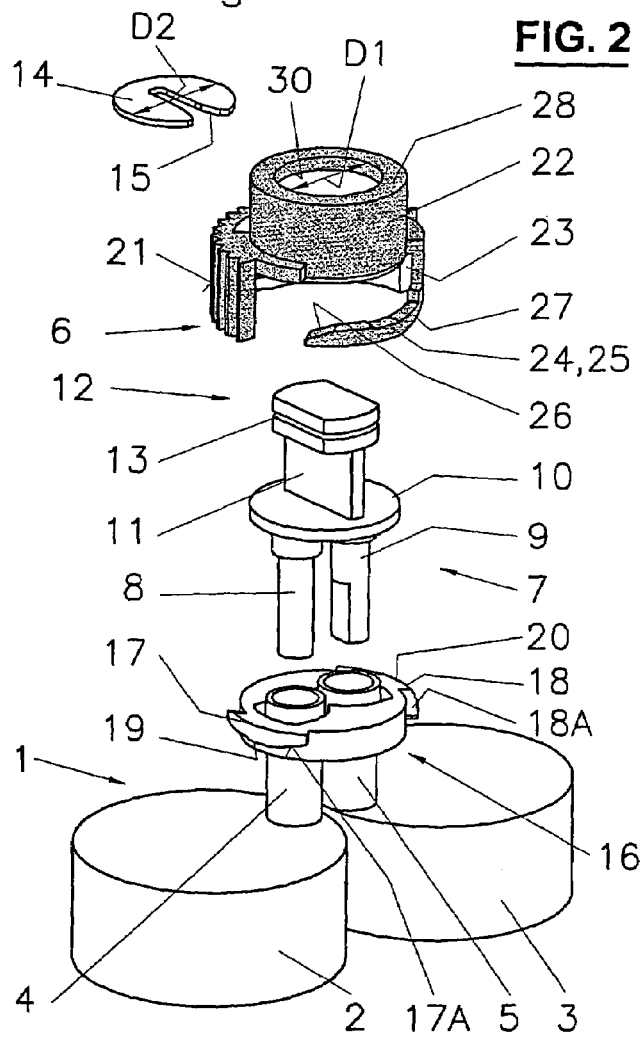
FIG. 2 shows the parts of FIG. 1 in an exploded view.

FIGS. 1 and 2 illustrate the outlet end of a double cartridge 1 comprising the two storage containers 2 and 3, the separate outlets 4 and 5, locking ring 6, and stopper 7.

The invention is mainly directed to lifting off stopper 7 from the cartridge through a rotation, here a counterclockwise rotation, of the locking ring. Stopper 7 includes two plugs 8 and 9, a tightening flange 10 and a following neck 11 provided with a traction flange 12 having a groove 13 for receiving a traction disk 14 with a recess 15.

An outlet flange 16 having two opposed flange ridges 17 and 18 is arranged in the end area of the two outlets 4 and 5. Each flange ridge includes on its lower side 19 a tightening slope 17A and on its upper side 20 a traction slope 18A, said slopes being oblique as seen in the axial direction. Tightening and traction slopes 17A and 18A on the outlet flange of the cartridge cooperate with corresponding tightening and traction flanges inside the locking ring.

Locking ring 6 has a corrugated turning portion 21 and a following cylindrical portion 22 having a smaller internal diameter than the turning portion, thereby forming a stepped portion 23 that rests on tightening flange 10 of stopper 7. Internal diameter D1 of passage 30 at the end of cylindrical portion 22 that is facing away from the plugs is smaller than diameter D2 of traction disk 14.

In the turning portion of the ring, near its end on the cartridge side, two opposed ring ridges 24 and 25 are arranged whose upper sides are provided with ring tightening slopes 26 and whose lower sides with ring traction slopes 27. Again, the ring tightening slopes and the ring traction slopes are oblique as seen in the axial direction.

Figure 3:
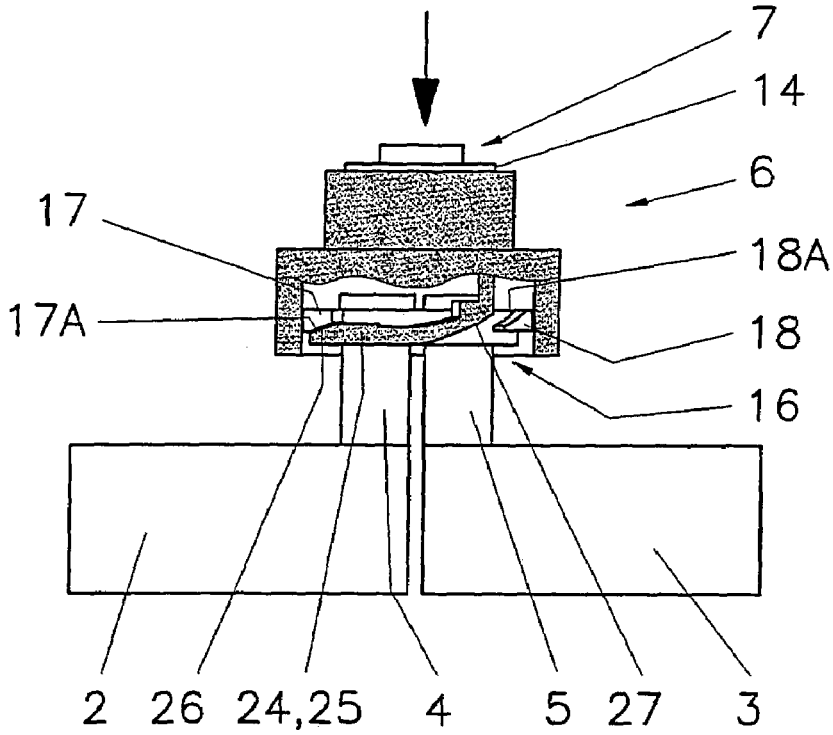
FIG. 3 shows the function of the locking ring in the closing direction.

FIG. 3 illustrates the function of the device in the tightening or closing position. In this position, ring ridges 24 and 25, whose upper sides are provided with ring tightening slopes 26 and 27, cooperate with respective lower tightening slopes 17A, 18A of flange ridges 17, 18 of outlet flange 16 in order to tighten or close the closure in the direction of the arrow through a rotation of the locking ring in the clockwise direction.

Figure 4:
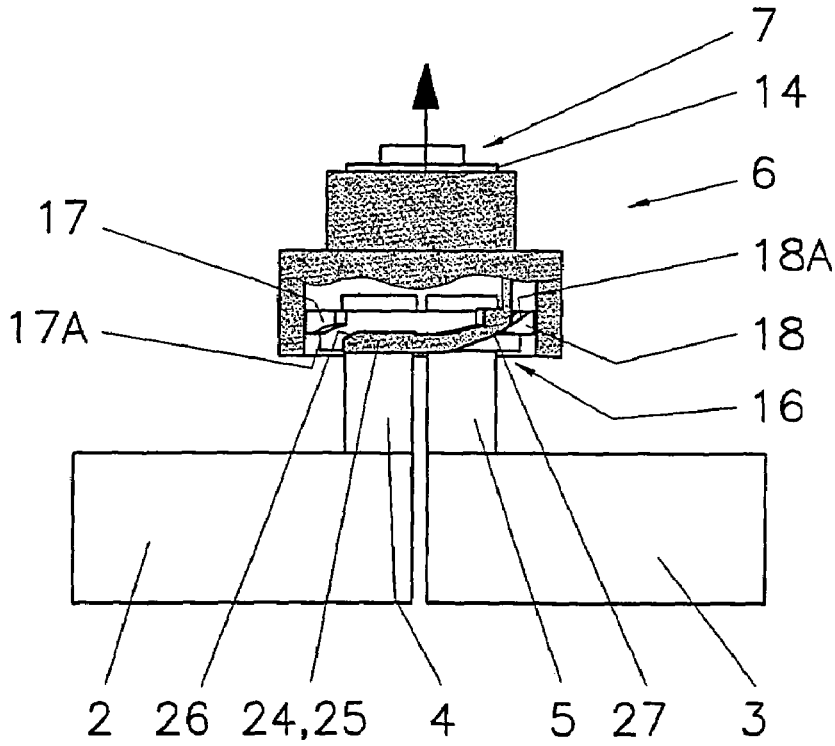
FIG. 4 shows the function of the locking ring while lifting off the stopper.

In FIG. 4, showing the traction movement in the direction of the arrow, lower traction slopes 26, 27 of the same ring ridges 24, 25 of locking ring 6 cooperate with upper traction slopes 17A, 18A of flange ridges 17, 18 of outlet flange 16 in order to release and lift off the stopper by means of the locking ring. Meanwhile, front face 28 of the locking ring acts upon traction disk 14.

Figure 5:
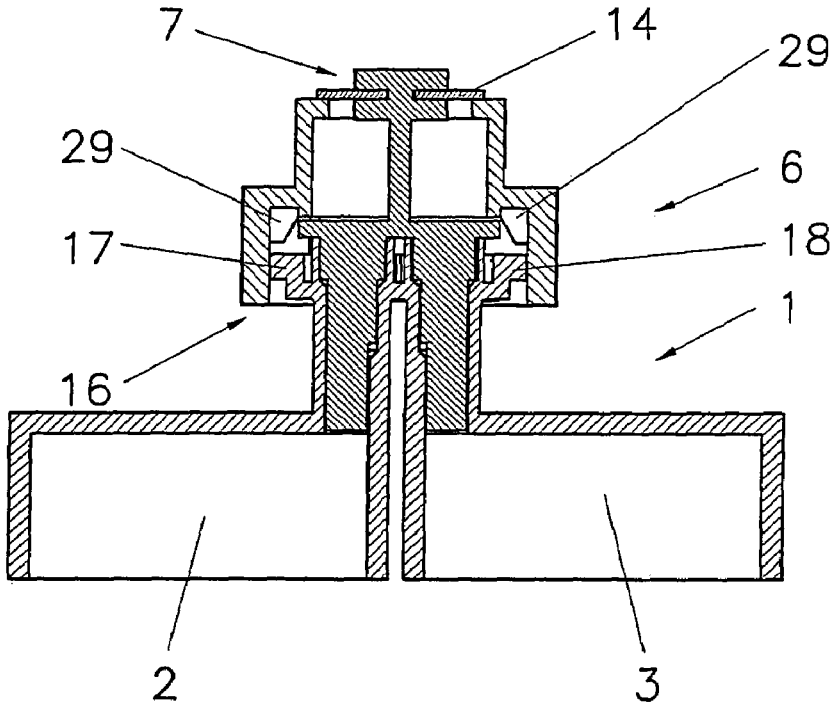
FIG. 5 shows a section according to line V-V in FIG. 1.
Figure 6:
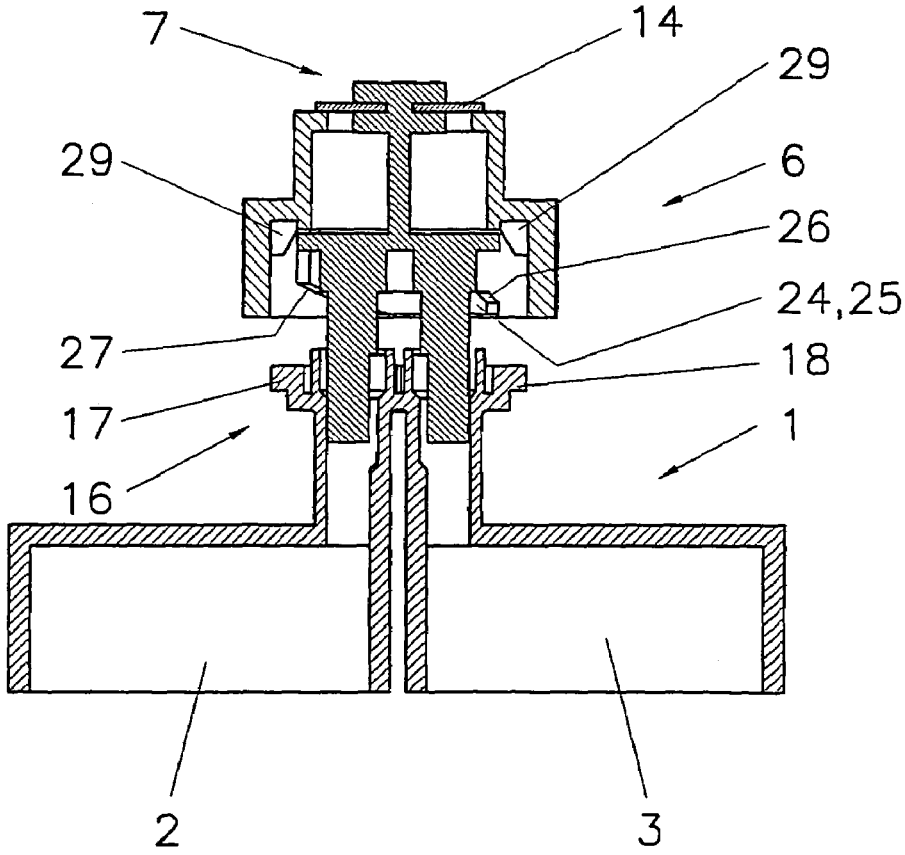
FIG. 6 shows the parts of FIG. 5 in another position.

In the turning portion of the locking ring, centering ridges 29 are furthermore arranged between ridges 24 and 25, at the junction with stepped portion 23, which extend obliquely from the turning portion to the cylindrical portion in the axial direction in order to allow the locking ring to be centered, see FIGS. 5 and 6.

FIG. 5 illustrates the stopper together with the locking ring in the locked position and FIG. 6 in the unlocked position. The drawings further show that in the locking operation, stepped portion 23 of the locking ring rests on tightening flange 10 of the stopper while the two tightening slopes cooperate to press the plugs of the stopper into the cartridge, and that in the unlocking operation, the annular front face 28 of the cylindrical portion of the stopper acts upon traction disk 14 engaged in a groove of the stopper while the two traction slopes cooperate to withdraw the stopper as it is unscrewed.

To close the cartridge outlets, the stopper, previously mounted in the locking ring, is first pushed into the outlets of the cartridge and locked by turning the ring by 90°. For unlocking, the locking ring is turned back a little more than 90° whereby the stopper is pulled out and can be removed together with the locking ring. Then, after taking out the traction disk, the stopper can be removed from the locking ring and that same locking ring can be used for attaching a mixer to the cartridge.

Figure 7:
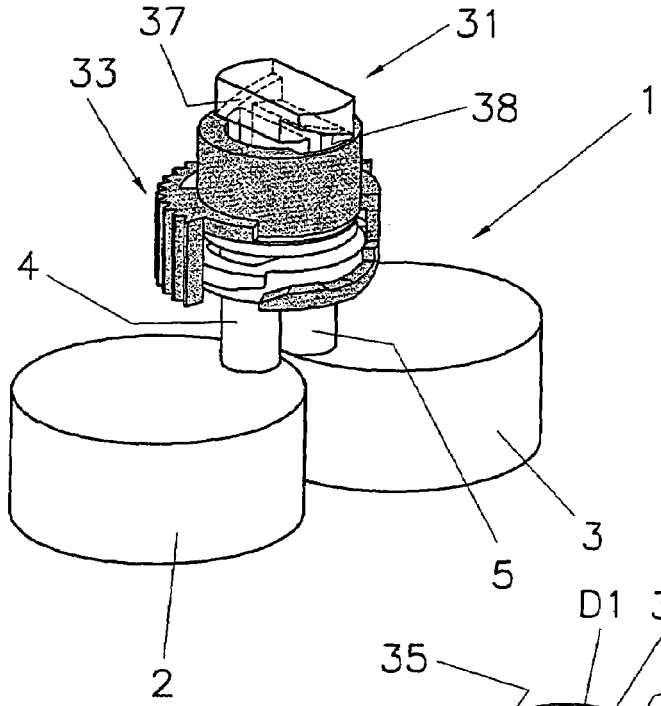
FIG. 7 shows an embodiment variant of the device according to the invention without a traction disk.
Figure 8:
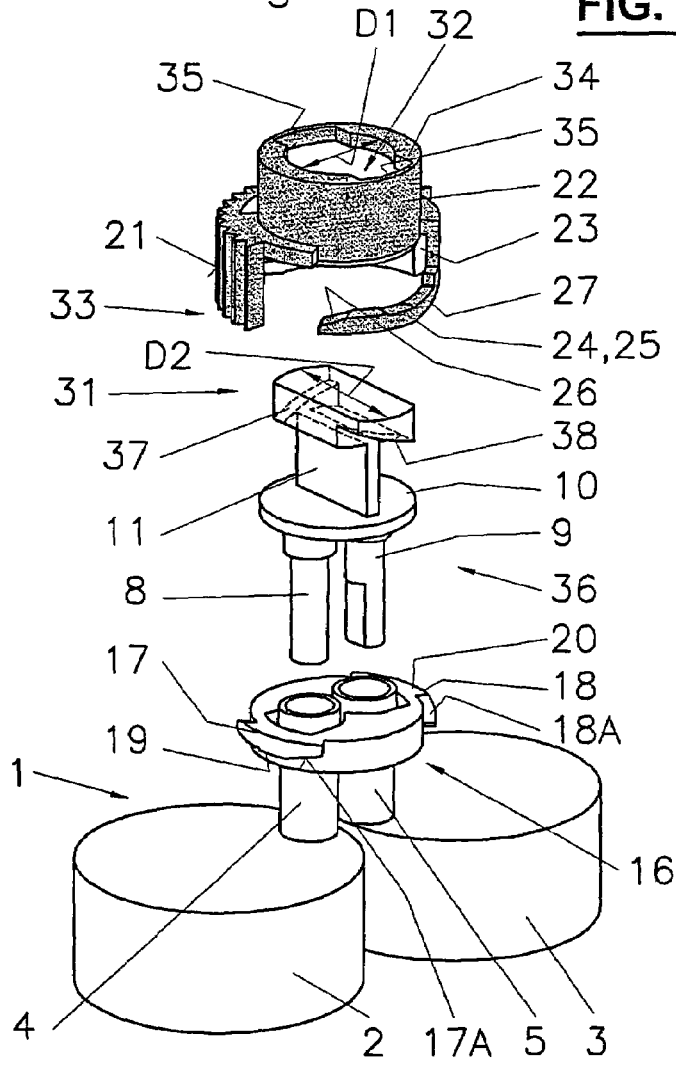
FIG. 8 shows the parts of FIG. 7 in an exploded view.

In the embodiment variant according to FIGS. 7 and 8, instead of using a traction disk, the longitudinal extension of traction flange 31 is prolonged, as compared to traction flange 12, to a length D2 that is greater than the diameter D1 of opening 32 of locking ring 33. In order to be able to place annular front face 34 under the traction flange, opposite sides of opening 32 are provided with respective recesses 35 that allow the passage of traction flange 31.

To reinforce the traction movement of stopper 35, the lower side of the traction flange includes two opposed traction slopes 38 and 37.

The remaining parts as well as the function are the same as in the first embodiment including a traction disk. The stopper is inserted and the locking ring is placed on the traction flange in such a manner that the latter extends through opening 32 during locking. For unlocking, the locking ring is first turned to release the stopper, and in a further turning movement, the stopper is pulled out. This solution offers the advantage of including one less losable part, i.e. the traction disk.

The just described solution including traction flange slopes is also applicable to an embodiment having a threaded locking ring where the screw thread cooperates with a threaded portion on the outlet flange of the dispensing device.

Based on the depicted exemplary embodiment, many variations are possible without leaving the scope of the invention. Thus, the outlet openings and/or the plugs may be conical, the outlet openings and accordingly also the plugs may deviate from the cylindrical shape and may e.g. be D-shaped, the bayonet-type locking as well as the unlocking operation may take place in the clockwise or counterclockwise direction, both the storage containers and the outlets may be dissimilar to one another and may e.g. have cross-sectional or volumetric ratios from 1:1 to 1:10, and the plugs of the stopper may differ both in diameter and in length. Instead of the traction disk, a spreader pin or a snap ring or the like may be used.

It is apparent from the description of the invention that the advantages of a bayonet coupling are conserved while the tightly fitting closure ensures a tight seal and an unproblematic storage and allows a simple, safe, and clean handling as well as an easy and rapid mounting and dismounting of the closure.

Although the described exemplary embodiment relates to a double cartridge, the closure and lift-off mechanism may also be used for other dispensing devices or cartridges, e.g. for single-component cartridges and for multicomponent cartridges or dispensing devices.

The invention claimed is:

1. A dispensing device comprising:

containers with respective outlets, said outlets having external surfaces;

a stopper configured to be received in the outlets; and a locking ring configured to connect a bayonet attachment to the device, wherein the external surfaces of the outlets include ridges, each comprising a traction slope on an upper side and a tightening slope on a lower side, and said locking ring includes corresponding ring ridges on an inside surface that are each provided with a traction slope on a lower side and with a tightening slip on an upper side, and wherein the outlet ridges and the ring ridges are configured to mutually cooperate to enable the stopper to be lifted off or moved toward the dispensing device as the locking ring is rotated.

2. The dispensing device according to claim 1, wherein the stopper further comprises a tightening flange that is connected to a stepped portion in the locking ring.

3. The dispensing device according to claim 2, wherein the stopper further comprises traction means arranged above the tightening flange and resting on an annular front face of the locking ring.

4. The dispensing device according to claim 2, wherein at its end facing away from a plug the stopper further comprises a removable traction disk whose diameter is greater than the diameter of the opening of the locking ring that is facing away from the dispensing device.

5. The dispensing device according to claim 2, wherein the stopper further comprises a traction flange whose longitudinal extension is greater than the diameter of the opening of the locking ring that is facing away from the dispensing device, the opening having two recesses that allow the locking ring to receive the traction flange in one position thereof.

6. The dispensing device according to claim 5, wherein the traction flange of the stopper comprises two traction flange slopes on its lower side that are inclined as seen in the axial direction.

7. The dispensing device according to claim 1, wherein the ridges are arranged on the circumference of an outlet flange.

8. The dispensing device according to claim 1, wherein traction and tightening slopes are inclined as seen in the axial direction.

9. The dispensing device according to claim 1, wherein the locking ring comprises axially arranged and radially inclined centering ridges in its interior.

10. The dispensing device according to claim 1, wherein the dispensing device is a double cartridge whose stopper comprises two plugs.

11. A dispensing device comprising:

containers with respective outlets, said outlets having external surfaces;

a stopper configured to be received in the outlets; and a locking ring configured to connect a bayonet attachment to the device, wherein the external surfaces of the outlets include ridges, each comprising a traction slope on an upper side and a tightening slope on a lower side, and said locking ring includes corresponding ring ridges on an inside surface that are each provided with a traction slope on a lower side and with a tightening slip on an upper side, and wherein the stopper includes a tightening flange that is configured to be moved by rotation of the locking ring so that the outlet ridges and the ring ridges are configured to mutually cooperate to enable the stopper to be lifted off or moved toward the dispensing device as the locking ring is rotated.

12. The dispensing device according to claim 11, wherein the stopper further comprises traction means arranged above the tightening flange and resting on an annular front face of the locking ring.

13. The dispensing device according to claim 11, wherein at its end facing away from a plug the stopper further comprises a removable traction disk whose diameter is greater than the diameter of the opening of the locking ring that is facing away from the dispensing device.

14. The dispensing device according to claim 11, wherein the stopper further comprises a traction flange whose longitudinal extension is greater than the diameter of the opening of the locking ring that is facing away from the dispensing device, the opening having two recesses that allow the locking ring to receive the traction flange in one position thereof.

15. The dispensing device according to claim 14, wherein the traction flange of the stopper comprises two traction flange slopes on its lower side that are inclined as seen in the axial direction.

16. The dispensing device according to claim 11, wherein the ridges are arranged on the circumference of an outlet flange.

17. The dispensing device according to claim 11, wherein traction and tightening slopes are inclined as seen in the axial direction.

18. The dispensing device according to claim 11, wherein the locking ring comprises axially arranged and radially inclined centering ridges in its interior.

19. The dispensing device according to claim 11, wherein the dispensing device is a double cartridge whose stopper comprises two plugs.

* * * * *